US008143866B2

(12) United States Patent
Fagnani et al.

(10) Patent No.: US 8,143,866 B2
(45) Date of Patent: Mar. 27, 2012

(54) CONTROL DEVICE FOR POWER FACTOR CORRECTION DEVICE IN FORCED SWITCHING POWER SUPPLIES

(75) Inventors: Mauro Fagnani, Nerviano (IT); Vincenzo Bartolo, Milan (IT); Claudio Adragna, Monza (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 535 days.

(21) Appl. No.: 12/367,117

(22) Filed: Feb. 6, 2009

(65) Prior Publication Data

US 2009/0141524 A1 Jun. 4, 2009

Related U.S. Application Data

(63) Continuation-in-part of application No. PCT/IT2006/000606, filed on Aug. 7, 2006.

(51) Int. Cl.
*G05F 1/00* (2006.01)

(52) U.S. Cl. ..... 323/222; 363/89

(58) Field of Classification Search ..... 323/207, 323/208, 210, 211, 222, 224, 235, 282–289; 363/16, 17, 81, 89, 21.04, 60, 95
See application file for complete search history.

(56) References Cited

U.S. PATENT DOCUMENTS

| | | | | |
|---|---|---|---|---|
| 5,063,491 | A | 11/1991 | Shigeo | |
| 5,359,276 | A * | 10/1994 | Mammano | 323/207 |
| 5,796,596 | A | 8/1998 | Williams | |
| 5,859,757 | A | 1/1999 | Hanafusa et al. | |
| 6,160,385 | A | 12/2000 | Feldtkeller | |
| 6,567,252 | B2 | 5/2003 | Kizmann et al. | |
| 6,657,417 | B1 * | 12/2003 | Hwang | 323/222 |
| 6,728,121 | B2 * | 4/2004 | Ben-Yaakov et al. | 363/89 |
| 6,756,771 | B1 * | 6/2004 | Ball et al. | 323/222 |
| 6,946,819 | B2 * | 9/2005 | Fagnani et al. | 323/207 |
| 6,970,365 | B2 * | 11/2005 | Turchi | 363/81 |
| 7,019,503 | B1 | 3/2006 | Ortiz et al. | |
| 7,091,588 | B2 * | 8/2006 | Akiyama et al. | 257/685 |
| 7,440,297 | B2 | 10/2008 | Adragna et al. | |
| 2002/0196644 | A1 | 12/2002 | Hwang | |

FOREIGN PATENT DOCUMENTS

EP 1 650 857 A2 4/2006

OTHER PUBLICATIONS

Various Authors, "Advanced transition-mode PFC controller," ST Data Sheet, L6563, pp. 1-37, Nov. 13, 2004. http://pdf1.alldatasheet.com/datasheet-pdf/view/158050/STMICROELECTRONCIS/L6563.html.

* cited by examiner

*Primary Examiner* — Rajnikant Patel
(74) *Attorney, Agent, or Firm* — Seed IP Law Group PLLC

(57) ABSTRACT

Herein described is a control device of a device for the correction of the power factor in forced switching power supplies; said device for the correction of the power factor comprises a converter and said control device is coupled to the converter to obtain from an alternating input line voltage a regulated output voltage. The control device comprises generating means associated to a capacitor for generating a signal representative of the root-mean-square value of the alternating line voltage; the generating means are associated to means for discharging said capacitor. The control device comprises further means for discharging the capacitor suitable for discharging said capacitor when the signal representative of the root-mean-square value of the alternating line voltage goes below a given value.

44 Claims, 9 Drawing Sheets

CONTROL DEVICE FOR POWER FACTOR CORRECTION DEVICE IN FORCED SWITCHING POWER SUPPLIES

CROSS-REFERENCE TO RELATED APPLICATION

This application is a continuation-in-part of International Patent Application No. PCT/IT2006/000606, filed Aug. 7, 2006, now pending, which application is incorporated herein by reference in its entirety.

BACKGROUND

1. Technical Field

The present disclosure refers to a control device for a power factor correction device in forced switching power supplies.

2. Description of the Related Art

The use of devices for active power factor correction (PFC) is generally known for forced switching power supplies used in the electronic appliances of common use such as computers, televisions, monitors, etc. and for the supply of fluorescent lamps, that is of forced switching pre-regulator stages whose task is to absorb from the line an almost sinusoidal current in phase with the line voltage. Therefore a forced switching power supply of the current type comprises a PFC and a direct current to direct current converter or DC-DC converter connected to the output of the PFC.

A forced switching power supply of the traditional type comprises a DC-DC converter and an input stage connected to the electricity distribution line made up of a full wave diode rectifier bridge and by a capacitor connected immediately downstream so as to produce a non-regulated direct current starting from the alternating sinusoidal line voltage. The capacitor's capacitance is large enough to ensure that at its terminals a relatively small ripple is present in relation to a direct level. The rectifier diodes of the bridge, therefore, will conduct only for a small portion of each half-cycle of the line voltage, given that the instantaneous value of this is lower than the voltage on the capacitor for the greatest part of the cycle. The consequence is that the current absorbed from the line will be formed by a series of narrow pulses whose width is 5-10 times the average resulting value.

This presents considerable consequences: the current absorbed by the line has much greater peak and root-mean-square (RMS) values in comparison to the case of absorption of sinusoidal current, the line voltage is distorted by effect of the nearly simultaneous impulsive absorption of all the utilities connected to the line, in the case of three-phase systems the current in the neutral conductor results much increased and there is a low utilization of the energetic potential of the electricity production system. In fact, the waveform of impulsive current is very rich with uneven harmonics which, even though not contributing to the power given to the load, contribute to increasing the effective current absorbed from the line and thus to increasing the dissipation of energy.

In quantitative terms all this can be expressed both in terms of power factor (PF), intended as ratio between the real power (that which the power supply gives to the load plus that dissipated internally in the form of heat) and the apparent power (the product of the effective line voltage by the effective current absorbed), and in terms of total harmonic distortion (THD), generally intended as percentage ratio between the energy associated with all the higher order harmonics and that associated with the fundamental harmonic. Typically, a power supply with capacitive filter has a PF between 0.4-0.6 and a THD exceeding 100%.

A PFC, placed between the rectifier bridge and the input of the DC-DC converter, permits the absorption from the line of a nearly sinusoidal current in phase with the voltage, making the PF near 1 and reducing the THD.

In FIG. 1 a pre-regulator stage PFC is schematically shown comprising a boost converter 20 and a control device 1, in this case the control device L6563 produced by STMicroelectronics S.p.A. The boost converter 20 comprises a full wave diode rectifier bridge 2 having in input an alternating line voltage Vin, a capacitor Cin (that serves as filter for the high frequency) having the terminals connected to the terminals of the diode bridge 2, an inductance L connected to a terminal of the capacitor Cin, a power MOS transistor M having the drain terminal connected to a terminal of the inductance L downstream of the latter and having the source terminal coupled to ground by means of a resistance Rs suitable for enabling the reading of the current that flows in the transistor M, a diode D having the anode connected to the common terminal of the inductance L and of the transistor M and the cathode connected to a capacitor Co having the other terminal connected to ground. The boost converter 20 generates in output a direct current Vout on the capacitor Co, which is the input voltage of a user stage connected in cascade, for example a DC-DC converter.

The control device 1 maintains the output voltage Vout at a constant value by means of a feedback control action. The control device 1 comprises an operational error amplifier 3 suitable for comparing a part of the output voltage Vout, that is the voltage Vr given by Vr=R2*Vout/(R2+R1) (where the resistances R1 and R2 are connected in series with each other and in parallel to the capacitor Co) with a reference voltage Vref, for example of the value of 2.5V, and suitable for generating an error signal Se proportional to their difference. The output voltage Vout presents a ripple at a frequency that is double that of the line and superimposed to the continuous value. If however the bandwidth of the error amplifier is considerably reduced (typically lower than 20 Hz) by means of the use of a suitable compensation line comprising at least one capacitor and assuming an almost stationary regular operation, that is with constant effective input voltage and output load, this ripple will be greatly mitigated and the error signal will become constant.

The error signal Se is sent to a multiplier 4 where it is multiplied by a signal Vi given by a part of the line voltage rectified by the diode bridge 2.

At the output of the multiplier 4 a signal Imolt is present given by a rectified sinusoid whose width depends on the effective line voltage and on the error signal Se. Said signal Imolt represents the sinusoidal reference for the modulation PWM. Said signal is placed in input to the non-inverting terminal of a comparator 6 at whose inverting input the voltage present on the resistance Rs is proportional to the current $I_L$.

If the signals in input to the comparator 6 are equal the same comparator 6 sends a signal to a control block 10 suitable for driving the transistor M and which, in this case, causes its turning off; therefore the output of the multiplier produces the peak current of the MOS transistor M which is enveloped by a rectified sinusoid.

After the transistor M has been turned off the inductor L discharges the energy stored in it on the load until it is completely emptied. At this point, the diode D opens and the drain node of the transistor M remains floating, therefore its voltage tends to the instantaneous input voltage through the resonance oscillations between the stray capacitance of the node and the inductance of the inductor L. Thus we see a rapid diminution of the voltage on the drain terminal of the transistor M that is sent in input to a device for detecting the passage through zero 13 through the auxiliary winding of the inductor L. The device 13 commands the turning on again of the transistor M, thus starting a new switching cycle.

The current absorbed from the line will be the low frequency component of the current of the inductor L, that is the average current per switching cycle (the switching frequency component is almost totally eliminated by the line filter placed at the input of the boost converter stage, always present for the electromagnetic compatibility regulations). For evident geometric reasons, the average current of the inductor is equal to half of the envelope of the peaks, and thus has a sinusoidal trend.

The multiplier 4 adjusts, by means of the error signal, the value of the sinusoidal reference for the PWM modulation upon variation of the load conditions and of the line voltage. In particular, considering the variations of the effective line voltage, if it, for example, doubles, the peak value also doubles; if the load does not change, and thus the power absorbed is constant, the input current, both the effective and the peak, once the transitory phase is over, halves in relation to the value that it had previously. The sinusoidal reference, nevertheless, is taken right from the rectified line voltage that is doubled. If the error signal did not intervene to correct the reference of the current (that is, if the regulation loop was open and thus the error signal was manually fixed), this would also become double (instead of half), thus giving place to a transfer of power four times greater. As the power requested by the load is constant, it would result in a considerable increase of the output voltage. The control loop, instead, reacting to this tendency, diminishes the value of the error signal so that the output of the multiplier becomes half of what it was previously.

Therefore the gain of the power block of a pre-regulator PFC depends in a quadratic manner on the line voltage and the error amplifier intervenes heavily to set the sinusoidal reference for the PWM modulation at the correct value independently from the line voltage.

Apart from the difficulties of planning the error amplifier, this strong dependence of its output voltage on the input voltage of the pre-regulator presents considerable consequences on the system. In first place, the quadratic variation of the gain of the power part implies a similar variation of the cutoff frequency of the open loop transfer function. If, then, the error amplifier is compensated to have 20 Hz band for the open loop transfer function at maximum line voltage, the band will be about 2 Hz at minimum line voltage, with the result of having an even slower dynamic response. In second place, by effect of the narrow band, the transient responses to sudden variations of the line voltage and of the output load will be very poor and there can be peaks of high voltage, limited only by the output dynamics of the multiplier, which is of the sinusoidal reference. These dynamics are set in such a manner that the maximum power requested by the load can pass to minimum line voltage, but this means that at maximum line voltage the pre-regulator is capable of carrying a power at least three times greater.

Finally, the fact that the output voltage of the error amplifier diminishes at the increase of the line voltage has a negative impact of the input current on the THD. In fact it can be demonstrated that the distortion of third harmonic introduced by the residual ripple superimposed at the continuous value present at the output of the error amplifier (whose gain at 100 Hz, for as much as it is low, is null) is proportional to the ratio between the peak-peak width of said ripple and the continuous value. The peak-peak width of the ripple is constant upon the variation of the line voltage, while the continuous value diminishes, thus the distortion of third harmonic increases.

These problems are usually solved by introducing in the control loop a feedforward of the line voltage and an inverter-squarer block ($1/V^2$) like that included in the marked box of FIG. 1. In input to the multiplier 4 there is therefore a signal in output from an inverter-squarer block 41 at whose input is present a voltage signal Vff representative of the root-mean-square value of the line voltage obtained by means of a block 42; the signal in output from the block 41 is $1/Vff^2$. The function of this circuitry is that, in the first place, to generate a continuous level of voltage representative of the effective line voltage and, in second place, to use said level to adapt the output voltage of the multiplier to the variations of the input voltage without moving the output of the error amplifier.

This voltage representative of the effective line voltage is generated by means of a circuit detecting the peak of the voltage V1 that comprises a diode and a capacitor Cff.

To eliminate the detection error caused by the direct fall of the diode use is made of a so-called "ideal diode", provided by interposing an operational amplifier connected to a non-inverting buffer and including the diode in the feedback. The capacitor Cff is equipped with a discharging means, that is, the resistance in parallel Rff so that the voltage at its terminals can adapt itself to the diminishing of the effective input voltage. This discharge, however, should be imperceptible in the environment of each half line cycle, so that the voltage at its terminals is, as much as possible, close to continuous. With the above mentioned conditions and considering the capacitance and resistance values that can be obtained in integrated form, it is convenient for the Rff and Cff to be elements placed outside the integrated control circuit.

However in the case of sudden drop in the line voltage, the system in FIG. 1 replies with an exponential trend having a time constant Rff*Cff which, for what was said, will be to the order of many hundreds of milliseconds. This leads to the feedforward system losing effectiveness for a time which is as long as the variation of the input voltage is large and is as long as the time constant Rff*Cff. In fact, even though the signal on the comparator 6 tends to increase, the signal Vff is still too high because of the slow discharging and the output of the multiplier cannot adapt itself to the new level of current in input requested. The result is that the error amplifier tends to go out of its range and its output to saturate high. This causes a deep undershoot in the output voltage that can carry the converter downstream, fed by the stage PFC, out of regulation.

BRIEF SUMMARY

One embodiment is a control device for power factor correction device in forced switching power supplies.

One embodiment is a control device of a device for the correction of the power factor in forced switching power supplies, said device for the correction of the power factor comprising a converter and said control device being coupled to the converter to obtain from an alternating input line voltage a regulated output voltage, said control device comprising generating means associated with a capacitor for generating a signal representative of the root-mean-square value of the alternating line voltage, said generating means being associated with means for discharging said capacitor, characterized in that it comprises further means for discharging said capacitor suitable for discharging said capacitor when said signal representative of the root-mean-square value of the alternating line voltage goes below a given value.

BRIEF DESCRIPTION OF THE SEVERAL VIEWS OF THE DRAWINGS

The characteristics and advantages of the present disclosure will appear evident from the following detailed description of an embodiment, illustrated as non-limiting example in the enclosed drawings, in which.

DETAILED DESCRIPTION

Figure 1:
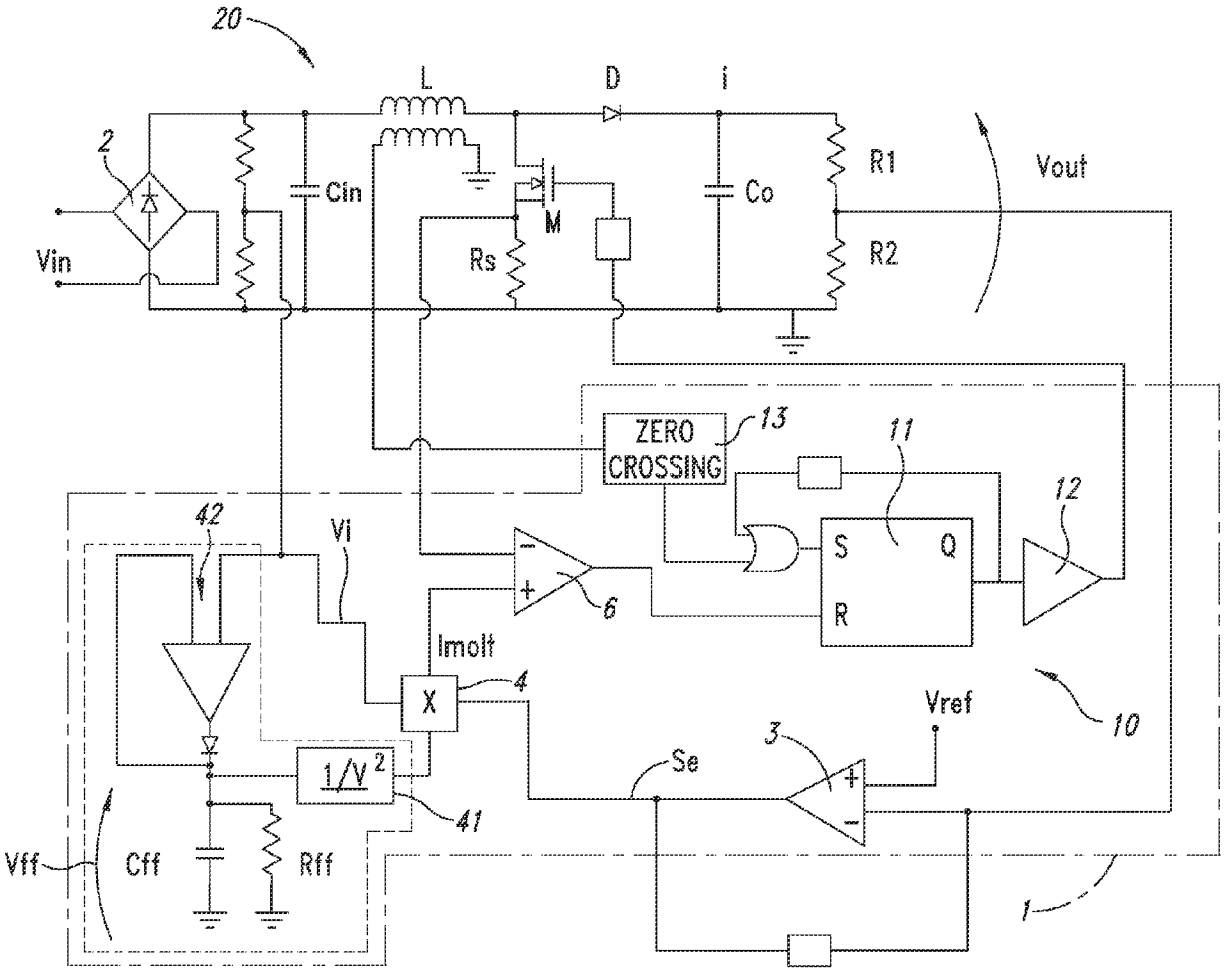
FIG. 1 (Prior Art)
FIG. 1 shows schematically a pre-regulator stage PFC in accordance with the known art.
Figure 2:
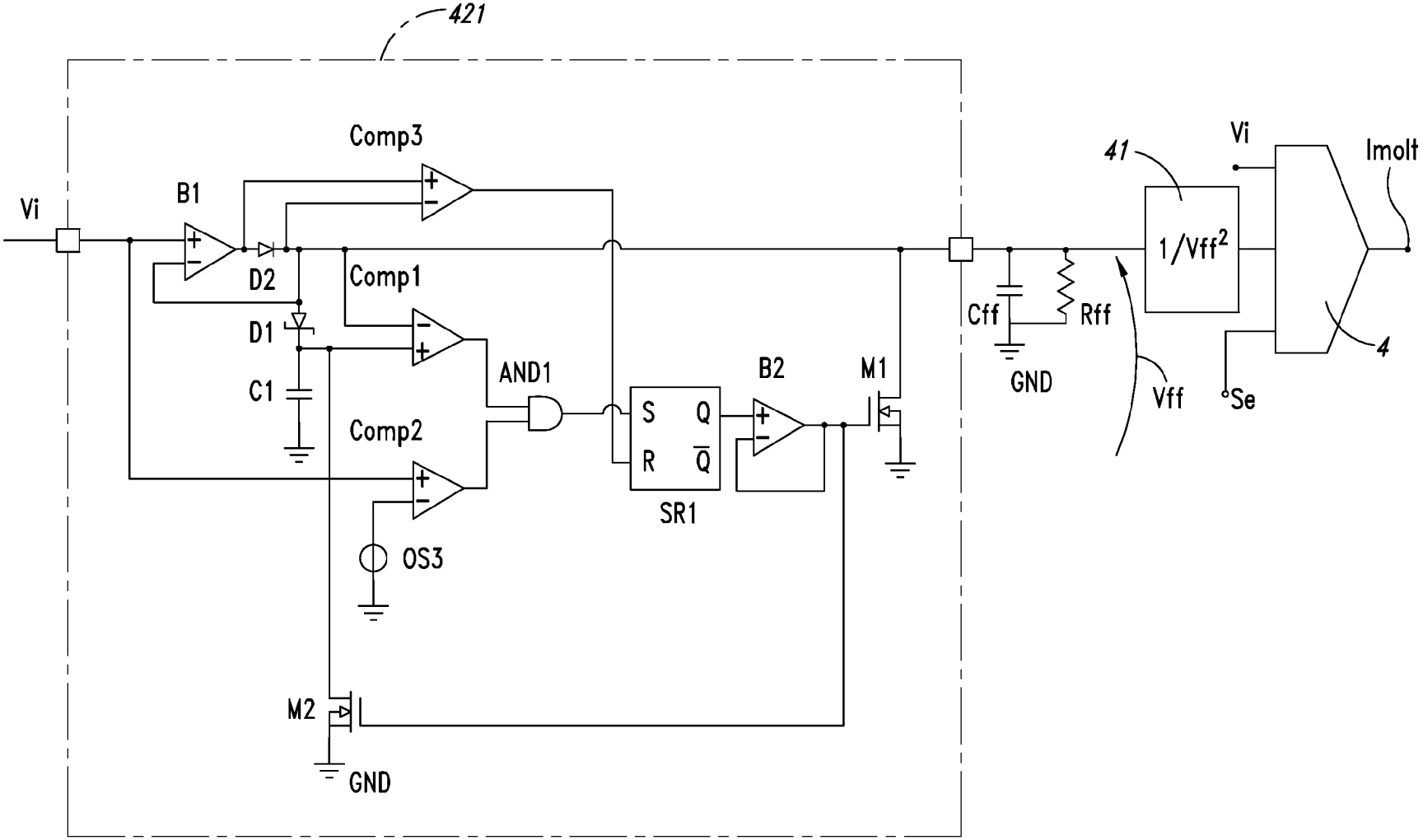
FIG. 2 shows a feedforward circuit of a control device of a pre-regulator PFC in accordance with a first embodiment.

With reference to FIG. 2 a feedforward circuit 421 is shown of a control device of a pre-regulator PFC in accordance with a first embodiment of the invention. Considering the pre-regulator PFC of FIG. 1, the feedforward circuit 421 is placed in substitution of the block 42. The feedforward circuit 421 comprises an operational amplifier B1 connected as a buffer and having the non-inverting input terminal connected to the voltage V1, the inverting input terminal connected to the cathode of a diode D2 having the anode connected with the output of the buffer B1. The feedforward circuit 421 comprises a capacitor C1 in which the peak value of the voltage V1 is memorized at less than a voltage offset due to a Schottky diode D1. The voltage Vffi on the capacitor C1 is used as a threshold of a comparator COMP1 that compares it with the voltage Vff. The offset on the voltage Vffi in comparison to the peak on the voltage V1 is sized keeping in consideration the time constant Rff*Cff and of the ripple to be obtained on the voltage Vff; during the normal functioning of the control device, the voltage Vffi should not have such a value that would change status at the output of the comparator COMP1. When instead there is a sudden drop in the line voltage, the voltage Vff goes below the voltage Vffi causing the triggering of the comparator COMP1. The output of the comparator COMP1 is coupled to the set input S of a set-reset latch SR1; with the signal of the set input S high, the signal Q of output of the set-reset latch SR1 is high and turns on a MOS transistor M1 having the drain terminal coupled with a terminal of the capacity Cff and the source terminal coupled with the other terminal of the capacitance Cff. The transistor M1 permits the rapid discharging of the capacitance Cff. The discharge remains until the voltage Vff hooks up to the line voltage; in that instant the set-reset latch is reset and the MOS transistor M1 is turned off. This is carried out by a comparator COMP3 having the inverting and non-inverting inputs connected to the terminals of the diode D2; the comparator COMP3 switches when current flows through the diode D2, that is during the charging of the capacitance Cff.

Preferably, should values of voltage Vff that are too low represent a problem for the input of the multiplier 4, the output of the comparator Comp1 is masked sending it in input to an AND gate AND1 having in input the output of a further comparator COMP2 having the non-inverting terminal connected to the voltage V1 and the inverting terminal connected to a reference voltage OS3 that remains low for a certain interval of time around the low of the signal Vi.

The circuit 421 also comprises a second MOS transistor M2 having the drain and source terminals connected to the terminals of the capacitance C1 and controlled by the signal Q in output from the latch SR1. The transistor M2 permits the discharge of the capacitor C1 to zero the voltage Vffi in relation to the new level of the line voltage. A buffer B2 is also provided placed between the output Q of the latch SR1 and the gate terminal of the transistor M1.

Figure 6:
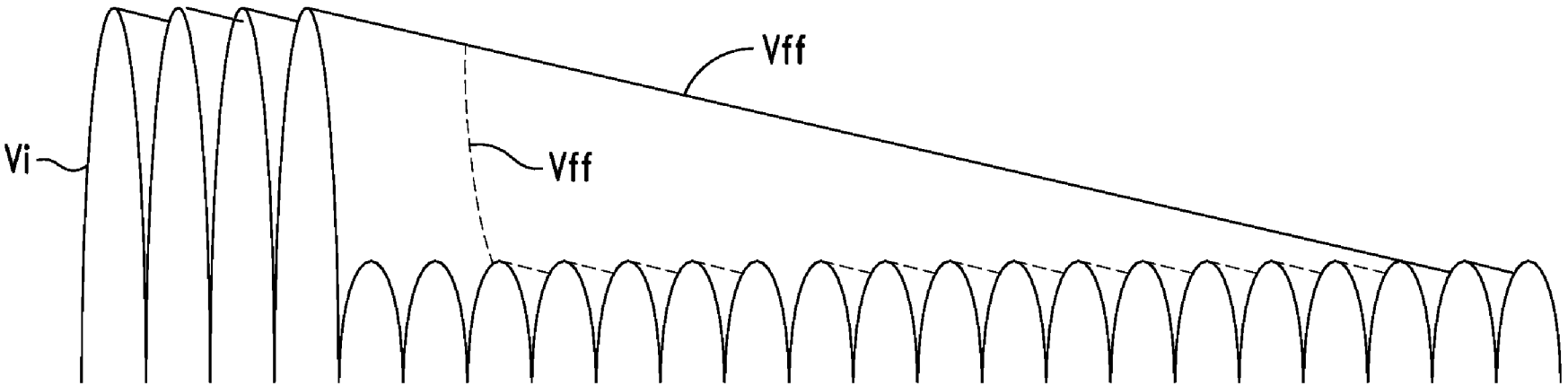
FIG. 6 shows the time diagrams of the voltage Vff in the control circuit of the known art and in the control circuit in accordance with the first embodiment.

In FIG. 6 the time diagrams are shown of the voltage Vi and of the voltage Vff (in continuous line) for the circuit of the known art and the voltage Vff for the circuit of FIG. 2 (dotted line).

Figure 3:
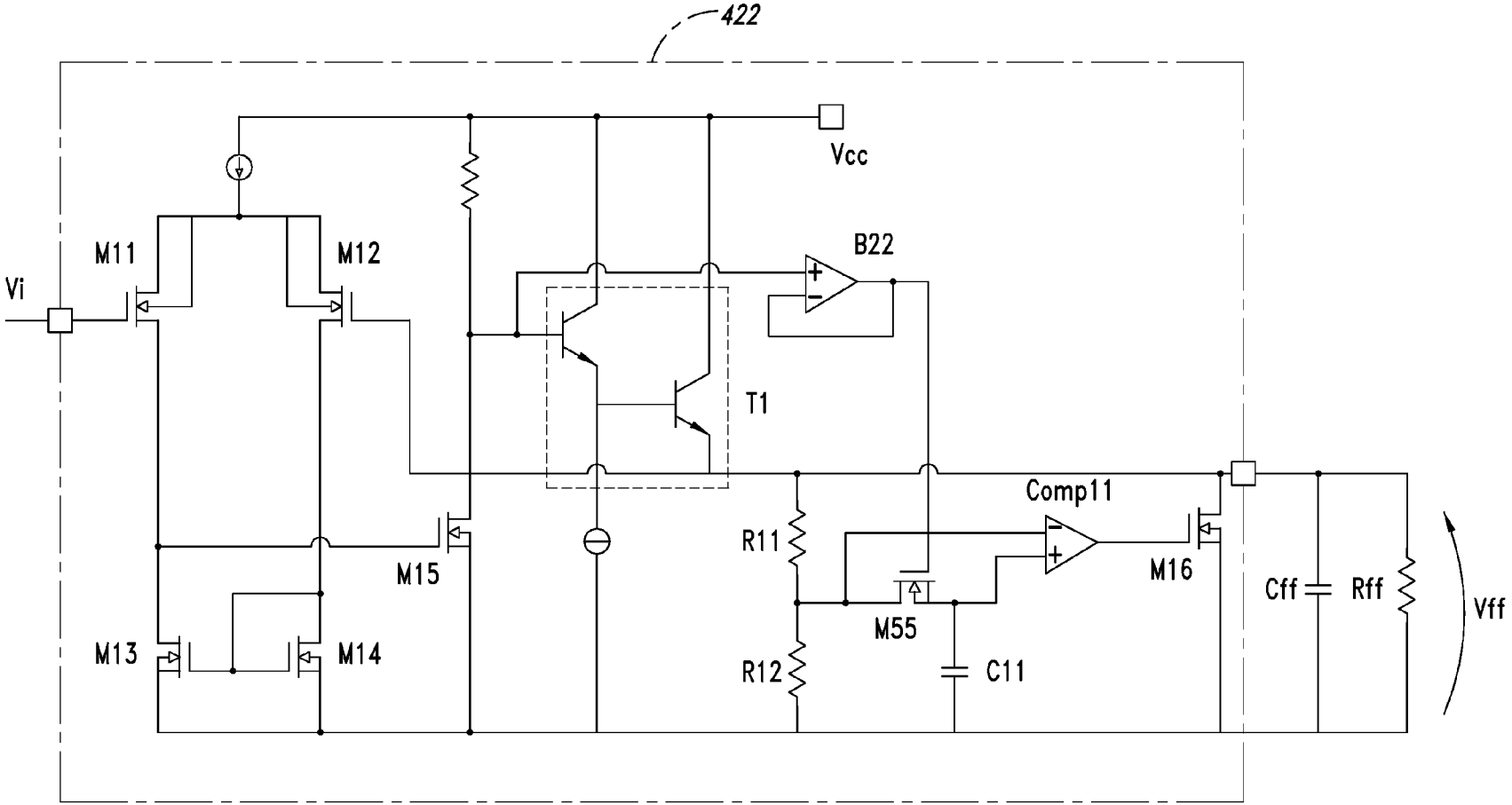
FIG. 3 shows a feedforward circuit of a control device of a pre-regulator PFC in accordance with a second embodiment.

With reference to FIG. 3 a feedforward circuit 422 of a control device of a pre-regulator PFC is shown in accordance with a second embodiment. The circuit 422 comprises a differential couple of transistors M11-M12 having in input the voltages Vi and Vff and a current mirror of transistors M13-M14 connected at the drain terminals of the transistors of the differential couple M11-M12; a Darlington transistor T1 is also present and the union of the circuit of transistors M1-M14 and of the transistor T1 constitutes the overall of the buffer B1 and of the diode D2 of FIG. 2. A MOS transistor M15 has the gate terminal connected to the drain terminal of the transistors M11, M13, the source terminal connected to ground GND and the drain terminal coupled to the supply voltage Vcc by means of a resistance, connected to the input terminal of the transistor T1 and connected to the input of a buffer B22 connected to the gate terminal of a transistor M55. A resistive divider R11-R12 takes a signal representative of the voltage Vff that is sent to the inverting terminal of a comparator COMP11. On the non-inverting terminal of the comparator COMP11 a capacitance C11 is placed suitably sized and connected to an end of the transistor M55 that puts it in communication with the divider R11-R12 and to ground GND. The transistor M55 is driven by a signal determined from the comparison between the voltage Vff and the signal Vi and is turned on every time there is an increase in load of the capacitance Cff through the transistor T1. If the peak voltage of the signal Vi diminishes, the transistor T1 does not turn on, the voltage Vff is not increased and the transistor M55 is not turned on. The voltage Vff will then tend to diminish by effect of the discharge of the capacitance Cff through the parallel of the resistances R11-R12 and Rff. If the comparator COMP11 is sized so that it has an offset exceeding the ripple present on the voltage Vff in normal conditions, the comparator switches only in the case of sudden drops in line voltage. In these cases the switching of the comparator turns on a MOS transistor M16 connected to the capacitance Cff to discharge it and thus permitting a more rapid convergence of the voltage Vff at its new regular working value.

Figure 7:
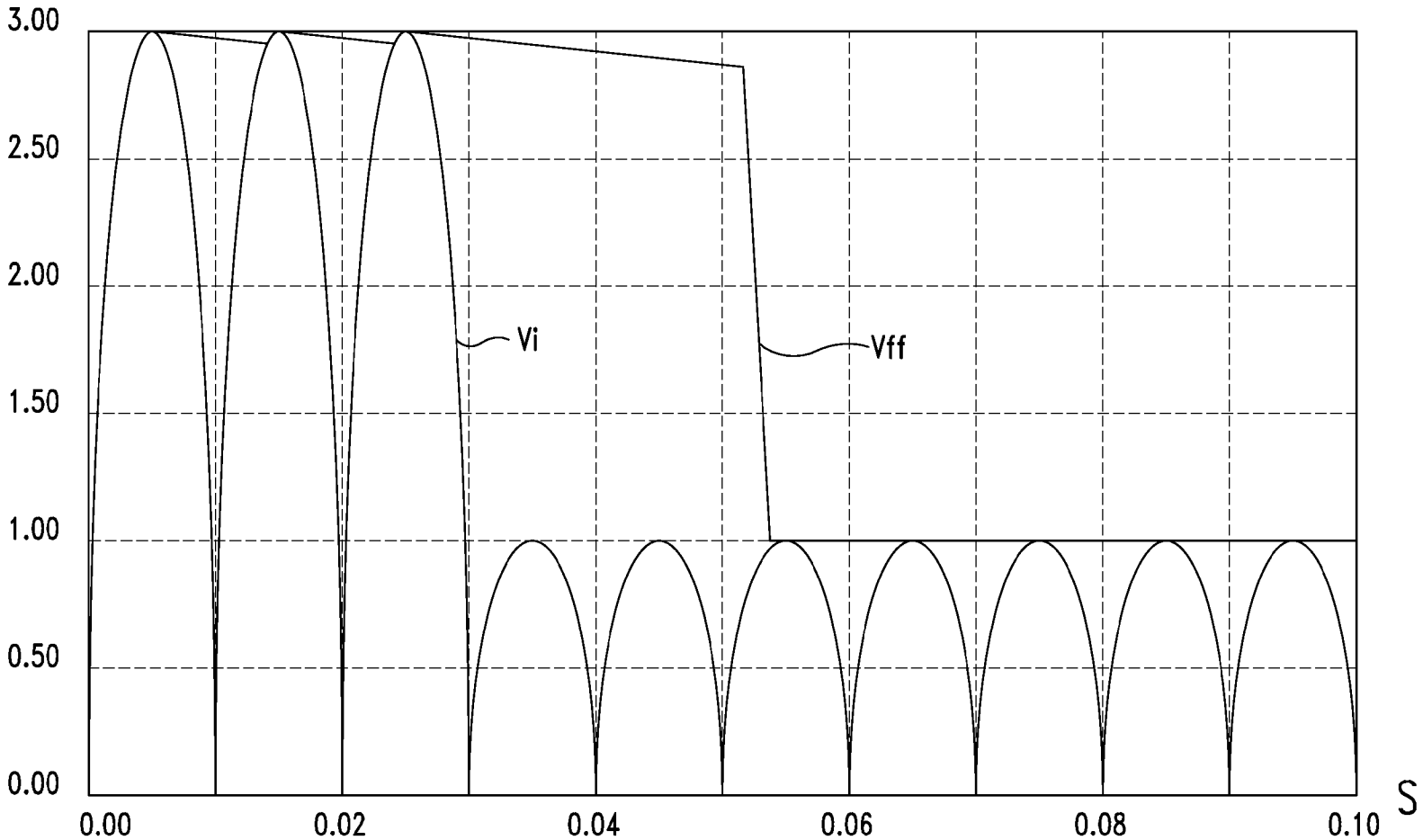
FIG. 7 shows the time diagram of the voltage Vff in the control circuit in accordance with the second embodiment.

In FIG. 7 are shown the time diagrams of the voltage V1 and of the voltage Vff for the circuit of FIG. 3.

Figure 4:
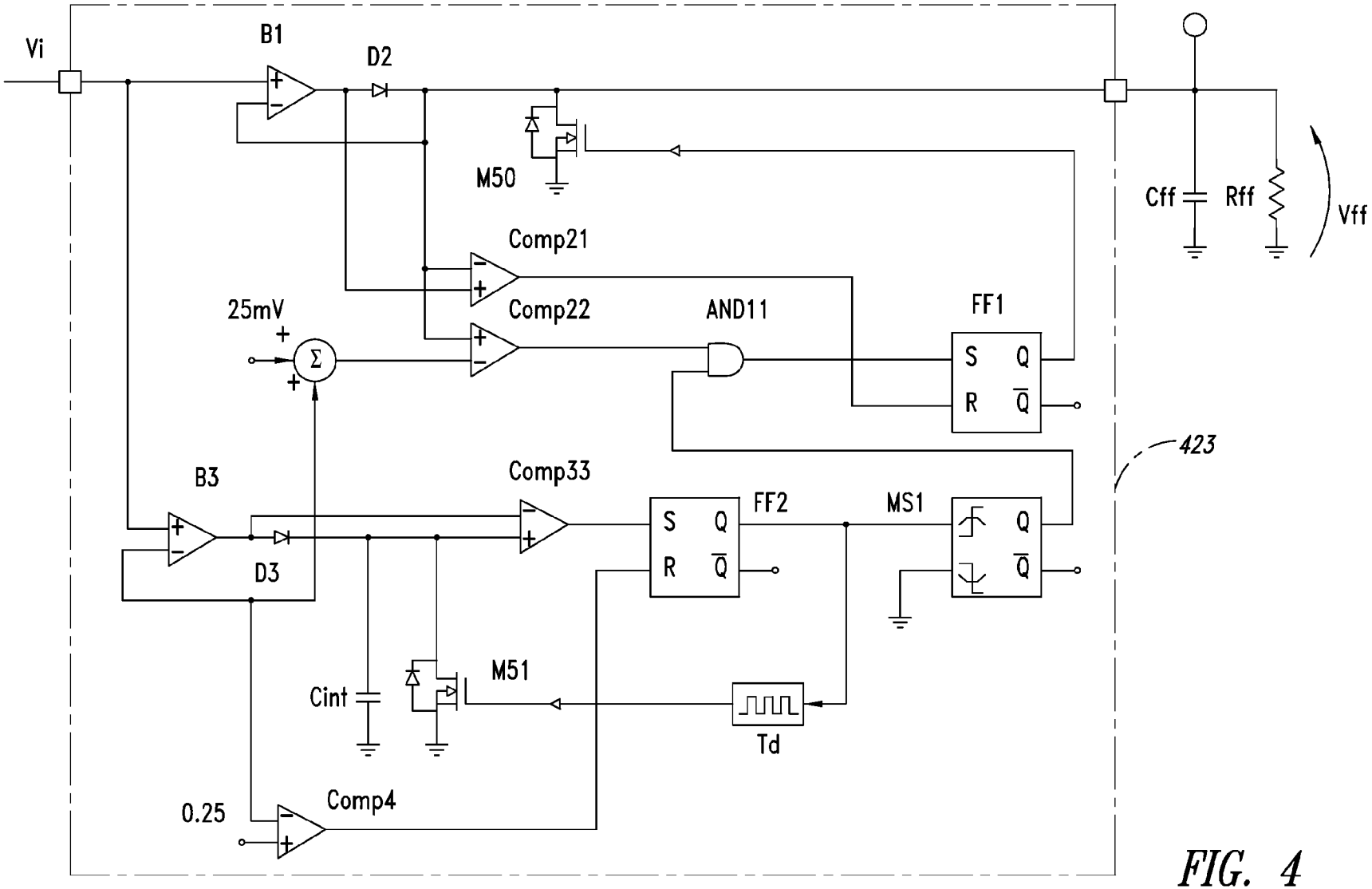
FIG. 4 shows a feedforward circuit of a control device of a pre-regulator PFC in accordance with a third embodiment.

With reference to FIG. 4 a feedforward circuit 423 of a control device of a pre-regulator PFC is shown in accordance with a third embodiment. The circuit 423 comprises, like the circuit of FIG. 2, an operational amplifier B1 connected as a buffer and having the non-inverting input terminal connected to the voltage V1, the inverting input terminal connected to the cathode of a diode D2 having the anode connected with the output of the buffer B1. The circuit 423 also comprises another operational amplifier connected to buffer B3 having the non-inverting input terminal connected to the voltage V1, the inverting input terminal connected to the cathode of a diode D3 having the anode connected with the output of the buffer B3; a capacitor Cint is placed between the cathode of the diode D3 and ground GND. Said circuit part acts as a peak detector and samples the peak value of the voltage V1 each half cycle. The moment the ideal diode composed of the buffer B3 and the diode D3 opens because the peak has been exceeded, which is detected by the comparator COMP3 having the inverting and non-inverting input terminals at the ends of the diode D3, an output signal is produced which is the set input S of a flip-flop FF2. The latter is set and in turn activates a monostable device MS1 that generates a pulse Tm of preset length, for example 20 μs; the monostable device MS1, through the AND gate AND11, enables for this period of time Tm the comparison between the voltage Vff and the value sampled on Cint. Said comparison is carried out by the comparator COMP22 if the difference Vff−Vint, where Vint is the voltage on Cint, exceeds a certain threshold (in the example, 25 mV), meaning that there has been a consistent diminishing of the line voltage, the flip-flop FF1 is set by means of the output of the AND gate AND11 which is the signal set s of the flip-flop FF1 and the MOS transistor M50, having the drain and source terminals placed at the ends of the capacitance Cff, is turned on rapidly discharging the capacitance Cff until its voltage reaches the instantaneous value of the voltage V1; this is signaled by the triggering of the comparator COMP21 having the non-inverting and inverting input terminals placed at the ends of the diode D2 and supplying an output signal that coincides with the input signal reset R of the flip-flop FF1. If not, FF1 is not set and the transistor M1 remains turned off.

Independently of the fact that the transistor M1 has been turned on or not, the capacitance Cint is discharged so that in the successive half cycle the capacitance Cint correctly samples the voltage V1. This is accomplished, after a certain delay Td from the activation of the flip-flop FF1, by a transistor M51, having the drain and source terminals placed at the ends of the capacity Cint, that is turned on to then be turned off as soon as FF2 is reset, that is when the voltage on Cint has gone below a certain level, definitely lower than the minimum value foreseen for the peak of the voltage V1.

Figure 8:
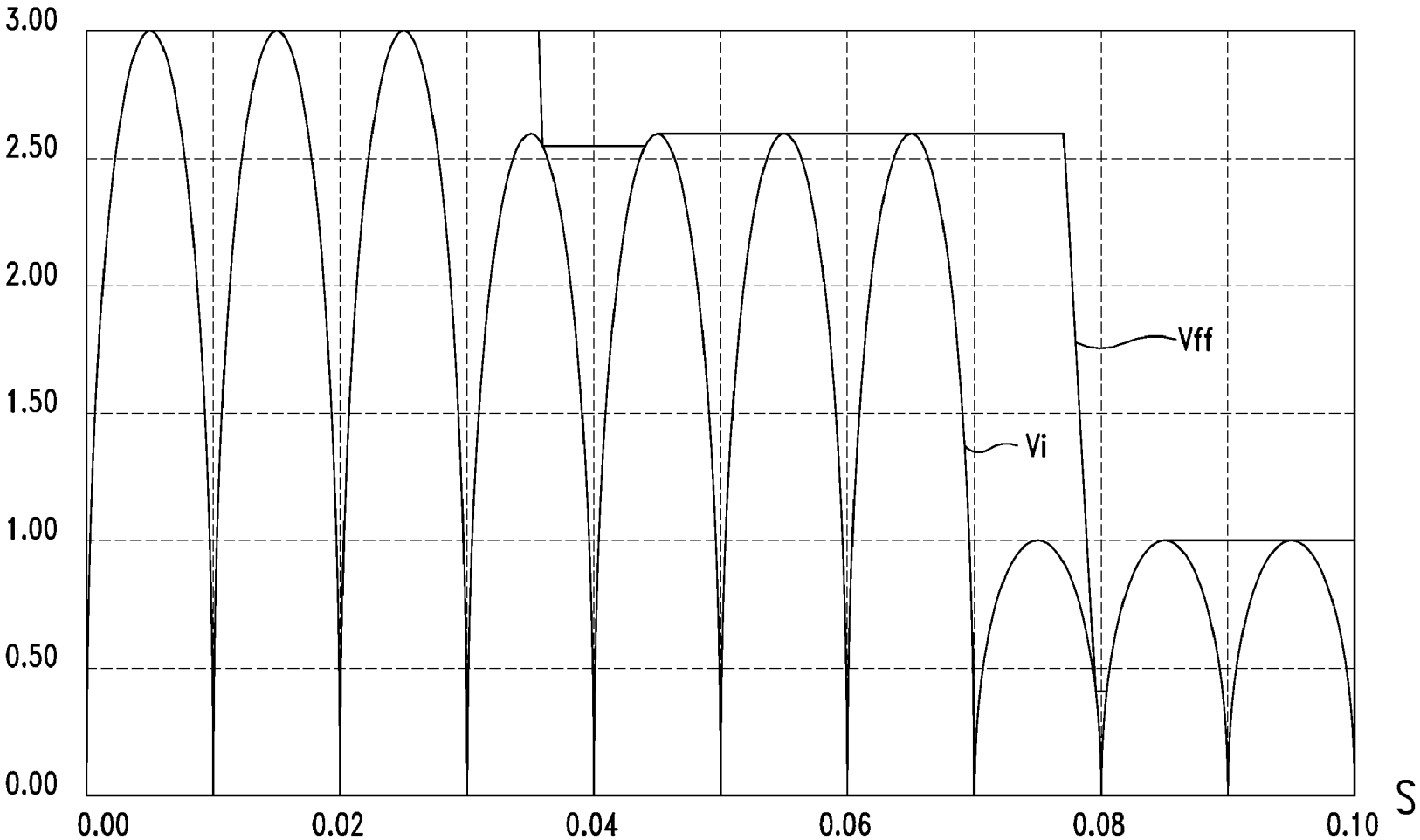
FIG. 8 shows the time diagram of the voltage Vff in the control circuit in accordance with the third embodiment.

In FIG. 8 the time diagrams of the voltage V1 and of the voltage Vff for the circuit 423 are shown in accordance with the third embodiment. From the graph it can be seen that in the case of the circuit of FIG. 4, the inconvenience of the circuits of the first and second embodiments caused by the delay between the moment in which there is the variation of the line voltage and the moment in which the system reacts adapting the value of the voltage Vff to the new condition, is limited to half a line cycle. This delay is caused by the decay time of the voltage Vff by effect of the resistance Rff, as well as of any internal resistances R1-R12. Wanting to contain this speed of decay to minimize the distortion brought about by the consequent ripple, the delay in intervention could also be relatively long.

Figure 5:
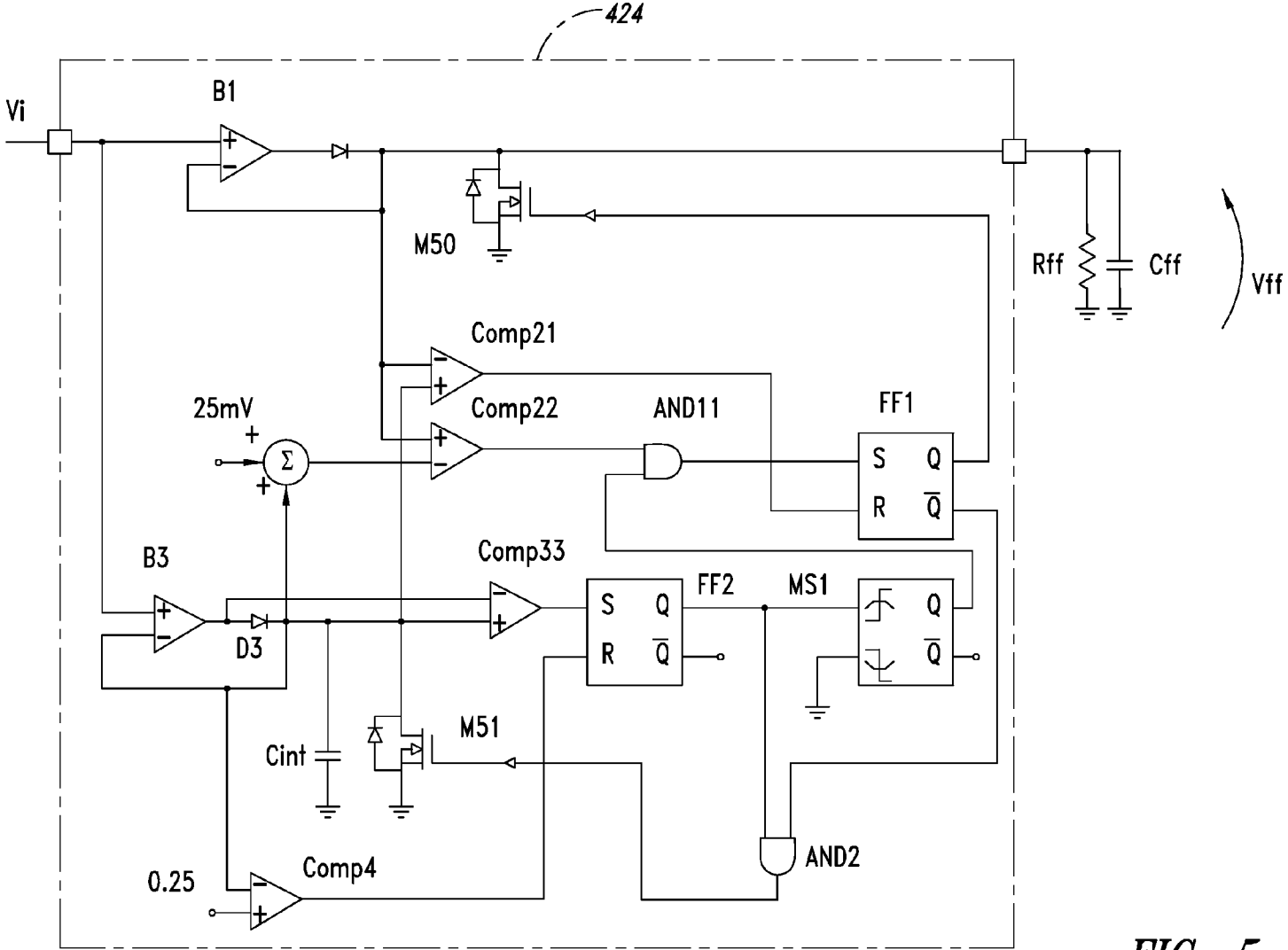
FIG. 5 shows a feedforward circuit of a control device of a pre-regulator PFC in accordance with a fourth embodiment.

Following very big transients the value of the voltage Vff can considerably go down below that which will be the new value. To avoid this with reference to FIG. 5, a feedforward circuit 424 of a control device of a pre-regulator PFC is provided in accordance with a fourth embodiment.

Figure 9:
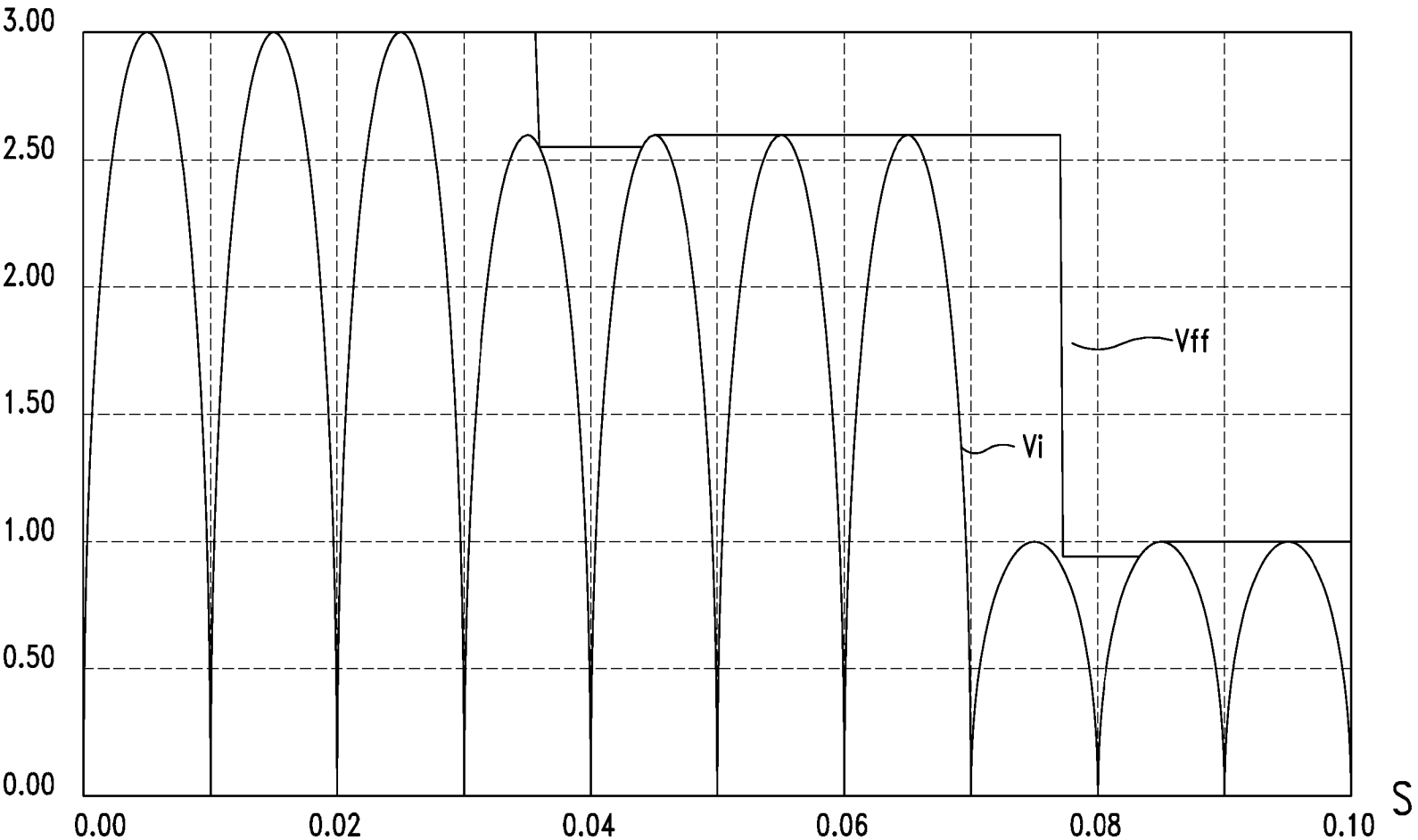
FIG. 9 shows the time diagram of the voltage Vff in the control circuit in accordance with the fourth embodiment.

The circuit 424 differs from the circuit 423 of FIG. 4 because the comparator COMP21 that resets the flip-flop FF1 compares the voltage Vff with the peak voltage sampled by the capacitor Cint, so as to turn off the transistor M50 as soon as the voltage Vff becomes lower than the voltage Vint and because the transistor M51 is turned on and, thus the capacitor Cint is discharged when, after having charged Cint to the peak value, the transistor M50 has completed the discharging of the capacitance Cff. The transistor M51 would be turned on immediately after the capacitor Cint has been charged to the value of peak if the transistor M50 is not completely turned on (because there has not been a diminishing of the input voltage). The results of the simulation of said circuit are given in the time diagrams of the voltages Vi and Vff of FIG. 9.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A control device for a power factor correction device, said control device comprising:
   - a capacitor;
   - generating means for generating a signal representative of a root-mean-square value of an alternating line voltage of the power factor correction device; and
   - discharging means for selectively discharging said capacitor in response to said signal representative of the root-mean-square value of the alternating line voltage going below a threshold value.

2. A control device according to claim 1, further comprising a drive circuit configured to drive a power transistor of the power factor correction device and configured to receive said signal representative of the root-mean-square value of the alternating line voltage.

3. A control device according to claim 2, further comprising an error amplifier having an inverting terminal configured to receive a signal proportional to a regulated output voltage of the power factor correct device and a non-inverting terminal configured to receive a reference voltage, said drive circuit comprising a multiplier coupled with an output of said generating means and with an output of said error amplifier and being suitable for generating a rectified sinusoid signal.

4. A control device according to claim 3, further comprising an inverter-squarer having in input said signal representative of the root-mean-square value of the alternating line voltage and having an output connected with said multiplier.

5. A control device according to claim 1, wherein said generating means are also for receiving a voltage signal from a rectifier of a converter of the power factor correction device.

6. A control device according to claim 5 wherein said threshold value is a voltage value proportional to a peak value of a part of the voltage signal from said rectifier, said discharging means comprising:
   - capacitive means for storing said voltage value proportional to said peak value,
   - a first comparator suitable for comparing said voltage value proportional to the peak value with a voltage at an end of said capacitor, and
   - a transistor coupled to the end of said capacitor, the transistor being activated when the voltage at the end of the capacitor goes below said voltage value proportional to the peak value.

7. A control device according to claim 6 wherein said generating means comprise:

a diode having an anode and a cathode; and an operational amplifier having a non-inverting input terminal configured to be coupled with an output of said rectifier, an output terminal connected to the anode of the diode, and an inverting input terminal connected to the cathode of said diode and to said capacitor.

8. A control device according to claim 7, wherein said discharging means comprise a second comparator having inputs connected respectively to the anode and to the cathode of said diode and being suitable for deactivating said transistor when current flows in said diode.

9. A control device according to claim 8 wherein said discharging means comprise:

a third comparator suitable for comparing said voltage signal from said rectifier with a reference signal that remains at low level for an interval of time around a low of the voltage signal from said rectifier; and an AND gate having a first input coupled to an output of the third comparator, a second input coupled to an output of said first comparator, and an output suitable for driving said transistor.

10. A control device according to claim 8 wherein said discharging means for discharging comprise means for discharging said capacitive means.

11. A control device according to claim 6 wherein said discharging means comprise:

a differential couple of transistors having a first input configured to be coupled to an output from the rectifier, a second input coupled to the end of said capacitor, and an output; and a Darlington transistor having an input coupled with the output of the differential couple of transistors and an output coupled to said capacitor;

first and second resistance coupled in series at the end of said capacitor and having a common terminal, a further transistor connected to the common terminal of said first and second resistances and to said capacitive means and configured to be driven by a signal determined by a comparison between the voltage signal from the rectifier and the voltage at the end of said capacitor.

12. A control device according to claim 5 wherein said threshold value is a peak value of a part of the voltage signal from said rectifier, said discharging means including:

capacitive means;

a sampling circuit suitable for sampling said peak value each half cycle;

a first comparator configured to compare the voltage at the end of said capacitor and the sampled value sampled by said sampling circuit when the voltage on said capacitive means has exceeded said peak value, a transistor placed at the end of said capacitor and configured to be activated by the first comparator when the difference between the voltage at the end of the capacitor and the sampled value exceeds a threshold voltage value.

13. A control device according to claim 12 wherein said generating means comprise:

a diode having an anode and a cathode; and an operational amplifier having a non-inverting input terminal configured to be coupled with an output of said rectifier, an output terminal connected to the anode of the diode, and an inverting input terminal connected to the cathode of said diode and to said capacitor.

14. A control device according to claim 13 wherein said discharging means comprise a second comparator suitable for comparing the voltage at the end of the capacitor and the sampled value and suitable for deactivating said transistor when the voltage at the end of the capacitor becomes lower than the sampled value.

15. A control device according to claim 12 wherein said further discharging means for discharging comprise means for discharging said capacitive means.

16. A control device according to claim 13 wherein said discharging means comprise a second comparator having inputs connected respectively to the anode and to the cathode of said diode and being suitable for deactivating said transistor when current flows in said diode.

17. A control device according to claim 13 wherein said discharging means comprise means for discharging said capacitive means and activating means for activating said means for discharging after the capacitor has been discharged.

18. A power factor correction device, comprising:

a converter; and a control device that includes:

a capacitor;

generating means for generating a signal representative of a root-mean-square value of an alternating line voltage of the power factor correction device; and discharging means for selectively discharging said capacitor in response to said signal representative of the root-mean-square value of the alternating line voltage going below a threshold value.

19. A power factor correction device according to claim 18, wherein said converter comprises a rectifier configured to rectify the alternating line voltage and provide an output voltage and said generating means are also for receiving the output voltage from the rectifier.

20. A power factor correction device according to claim 19 wherein said threshold value is a voltage value proportional to a peak value of a part of the output voltage from said rectifier, said discharging means comprising:

capacitive means for storing said voltage value proportional to said peak value, a first comparator suitable for comparing said voltage value proportional to the peak value with a voltage at an end of said capacitor, and a transistor coupled to the end of said capacitor, the transistor being activated when the voltage at the end of the capacitor goes below said voltage value proportional to the peak value.

21. A power factor correction device according to claim 20 wherein:

said generating means comprise:

a diode having an anode and a cathode; and an operational amplifier having a non-inverting input terminal configured to be coupled with an output of said rectifier, an output terminal connected to the anode of the diode, and an inverting input terminal connected to the cathode of said diode and to said capacitor; and said discharging means comprise a second comparator having inputs connected respectively to the anode and to the cathode of said diode and being suitable for deactivating said transistor when current flows in said diode.

22. A power factor correction device according to claim 21 wherein said discharging means comprise:

a third comparator suitable for comparing said voltage signal from said rectifier with a reference signal that remains at low level for an interval of time around a low of the voltage signal from said rectifier; and an AND gate having a first input coupled to an output of the third comparator, a second input coupled to an output of said first comparator, and an output suitable for driving said transistor.

23. A power factor correction device according to claim 19 wherein said discharging means comprise:

a differential couple of transistors having a first input configured to be coupled to an output from the rectifier, a second input coupled to an end of said capacitor, and an output; and first and second resistance coupled in series at the end of said capacitor and having a common terminal, a further transistor connected to the common terminal of said first and second resistances and to said capacitive means and configured to be driven by a signal determined by a comparison between the voltage signal from the rectifier and a voltage at the end of said capacitor.

24. A power factor correction device according to claim 19 wherein said threshold value is a peak value of a part of the voltage signal from said rectifier, said discharging means including:

capacitive means;

a sampling circuit suitable for sampling said peak value each half cycle;

a first comparator configured to compare a voltage at an end of said capacitor and the sampled value sampled by said sampling circuit when the voltage on said capacitive means has exceeded said peak value, a transistor placed at the end of said capacitor and configured to be activated by the first comparator when the difference between the voltage at the end of the capacitor and the sampled value exceeds a threshold voltage value.

25. A power factor correction device according to claim 24 wherein said discharging means comprise a second comparator suitable for comparing the voltage at the end of the capacitor and the sampled value and suitable for deactivating said transistor when the voltage at the end of the capacitor becomes lower than the sampled value.

26. A power factor correction device according to claim 20 wherein said generating means include a diode coupled between said rectifier and said capacitor and said discharging means comprise a second comparator having inputs connected respectively to an anode and to a cathode of said diode and being suitable for deactivating said transistor when current flows in said diode.

27. A control device for a power factor correction device, said control device comprising:

a first capacitor configured to store, a signal representative of a root-mean-square value of an alternating line voltage of the power factor correction device; and a switch coupled in parallel with the first capacitor; and a comparison circuit configured to compare the signal representative of the root-mean-square value with a threshold value and cause the switch to discharge the first capacitor when said signal representative of the root-mean-square value goes below the threshold value.

28. A control device of claim 27, further comprising a second capacitor configured to store the threshold value, the second capacitor being coupled to an input of the comparison circuit.

29. A control device of claim 27, further comprising:

a diode coupled between an input terminal and the first capacitor and having an anode and a cathode; and a comparator having first and second inputs coupled respectively to the anode and cathode of the diode and an output coupled to a control terminal of the switch, the comparator being configured to cause the switch to discharge the first capacitor in response to detecting a current through the diode.

30. A control device of claim 27, wherein the comparison circuit is configured to selectively discharge the first capacitor in response to said signal representative of the root-mean-square value going below the threshold value.

31. A control device for a power factor correction device, said control device comprising:

a capacitor;

generating means for generating a signal representative of a root-mean-square value of an alternating line voltage of the power factor correction device and for receiving a voltage signal from a rectifier of a converter of the power factor correction device, the generating means including:

a diode having an anode and a cathode, and an operational amplifier having a non-inverting input terminal configured to be coupled with an output of said rectifier, an output terminal connected to the anode of the diode, and an inverting input terminal connected to the cathode of said diode and to said capacitor; and discharging means for discharging said capacitor when said signal representative of the root-mean-square value of the alternating line voltage goes below a threshold value.

32. A control device according to claim 31, wherein:

said threshold value is a voltage value proportional to a peak value of a part of the voltage signal from said rectifier; and said discharging means include:

capacitive means for storing said voltage value proportional to said peak value, a first comparator suitable for comparing said voltage value proportional to the peak value with a voltage at an end of said capacitor, and a transistor coupled to the end of said capacitor, the transistor being activated when the voltage at the end of the capacitor goes below said voltage value proportional to the peak value.

33. A control device according to claim 32, wherein said discharging means comprise a second comparator having inputs connected respectively to the anode and to the cathode of said diode and being suitable for deactivating said transistor when current flows in said diode.

34. A control device for a power factor correction device, said control device comprising:

a capacitor;

generating means for generating a signal representative of a root-mean-square value of an alternating line voltage of the power factor correction device and for receiving a voltage signal from a rectifier of a converter of the power factor correction device, said discharging means including:

a differential couple of transistors having a first input configured to be coupled to an output from the rectifier, a second input coupled to the end of said capacitor, and an output, a Darlington transistor having an input coupled with the output of the differential couple of transistors and an output coupled to said capacitor, first and second resistances coupled in series at the end of said capacitor and having a common terminal, and a further transistor connected to the common terminal of said first and second resistances and to said capacitive means and configured to be driven by a signal determined by a comparison between the voltage signal from the rectifier and the voltage at the end of said capacitor; and discharging means for discharging said capacitor when said signal representative of the root-mean-square value of the alternating line voltage goes below a threshold value.

35. A control device according to claim 34, wherein:

said threshold value is a voltage value proportional to a peak value of a part of the voltage signal from said rectifier; and said discharging means include:

capacitive means for storing said voltage value proportional to said peak value, a first comparator suitable for comparing said voltage value proportional to the peak value with a voltage at an end of said capacitor, and a transistor coupled to the end of said capacitor, the transistor being activated when the voltage at the end of the capacitor goes below said voltage value proportional to the peak value.

36. A control device for a power factor correction device, said control device comprising:

a capacitor;

generating means for generating a signal representative of a root-mean-square value of an alternating line voltage of the power factor correction device and for receiving a voltage signal from a rectifier of a converter of the power factor correction device; and discharging means for discharging said capacitor when said signal representative of the root-mean-square value of the alternating line voltage goes below a threshold value, wherein said threshold value is a peak value of a part of the voltage signal from said rectifier, said discharging means including:

capacitive means, a sampling circuit suitable for sampling said peak value each half cycle, a first comparator configured to compare the voltage at the end of said capacitor and the sampled value sampled by said sampling circuit when the voltage on said capacitive means has exceeded said peak value, and a transistor placed at the end of said capacitor and configured to be activated by the first comparator when the difference between the voltage at the end of the capacitor and the sampled value exceeds a threshold voltage value.

37. A control device according to claim 36 wherein said generating means comprise:

a diode having an anode and a cathode; and an operational amplifier having a non-inverting input terminal configured to be coupled with an output of said rectifier, an output terminal connected to the anode of the diode, and an inverting input terminal connected to the cathode of said diode and to said capacitor.

38. A control device according to claim 36 wherein said further discharging means for discharging comprise means for discharging said capacitive means.

39. A power factor correction device, comprising:

a converter having a rectifier configured to rectify an alternating line voltage and provide an output voltage; and a control device that includes:

a capacitor, generating means for generating a signal representative of a root-mean-square value of the alternating line voltage of the power factor correction device and for receiving the output voltage from the rectifier, said generating means, including:

a diode having an anode and a cathode, and an operational amplifier having a non-inverting input terminal configured to be coupled with an output of said rectifier, an output terminal connected to the anode of the diode, and an inverting input terminal connected to the cathode of said diode and to said capacitor, and discharging means for discharging said capacitor when said signal representative of the root-mean-square value of the alternating line voltage goes below a threshold value, wherein said threshold value is a voltage value proportional to a peak value of a part of the output voltage from said rectifier, said discharging means including:

capacitive means for storing said voltage value proportional to said peak value, a first comparator suitable for comparing said voltage value proportional to the peak value with a voltage at an end of said capacitor, a transistor coupled to the end of said capacitor, the transistor being activated when the voltage at the end of the capacitor goes below said voltage value proportional to the peak value, and a second comparator having inputs connected respectively to the anode and to the cathode of said diode and being suitable for deactivating said transistor when current flows in said diode.

40. A power factor correction device according to claim 39 wherein said discharging means comprise:

a third comparator suitable for comparing said voltage signal from said rectifier with a reference signal that remains at low level for an interval of time around a low of the voltage signal from said rectifier; and an AND gate having a first input coupled to an output of the third comparator, a second input coupled to an output of said first comparator, and an output suitable for driving said transistor.

41. A power factor correction device, comprising:

a converter having a rectifier configured to rectify the alternating line voltage and provide an output voltage; and a control device that includes:

a capacitor, generating means for generating a signal representative of a root-mean-square value of an alternating line voltage of the power factor correction device and for receiving the output voltage from the rectifier, and discharging means for discharging said capacitor when said signal representative of the root-mean-square value of the alternating line voltage goes below a threshold value, said discharging means including:

a differential couple of transistors having a first input configured to be coupled to an output from the rectifier, a second input coupled to an end of said capacitor, and an output, first and second resistances coupled in series at the end of said capacitor and having a common terminal, and a further transistor connected to the common terminal of said first and second resistances and to said capacitive means and configured to be driven by a signal determined by a comparison between the voltage signal from the rectifier and a voltage at the end of said capacitor.

42. A power factor correction device according to claim 41, wherein the converter includes a power transistor and the control device includes a drive circuit configured to drive the power transistor and configured to receive said signal representative of the root-mean-square value of the alternating line voltage.

43. A power factor correction device, comprising:

a converter having a rectifier configured to rectify the alternating line voltage and provide an output voltage; and a control device that includes:

a capacitor, generating means for generating a signal representative of a root-mean-square value of an alternating line voltage of the power factor correction device and for receiving the output voltage from the rectifier, and discharging means for discharging said capacitor when said signal representative of the root-mean-square value of the alternating line voltage goes below a threshold value, wherein said threshold value is a peak value of a part of the voltage signal from said rectifier, said discharging means including:

capacitive means, a sampling circuit suitable for sampling said peak value each half cycle, a first comparator configured to compare a voltage at an end of said capacitor and the sampled value sampled by said sampling circuit when the voltage on said capacitive means has exceeded said peak value, and a transistor placed at the end of said capacitor and configured to be activated by the first comparator when the difference between the voltage at the end of the capacitor and the sampled value exceeds a threshold voltage value.

44. A power factor correction device according to claim 43 wherein said discharging means comprise a second comparator suitable for comparing the voltage at the end of the capacitor and the sampled value and suitable for deactivating said transistor when the voltage at the end of the capacitor becomes lower than the sampled value.

* * * * *